US008549679B2

(12) United States Patent
Tindall

(10) Patent No.: US 8,549,679 B2
(45) Date of Patent: Oct. 8, 2013

(54) PERSONAL LIFTING DEVICE

(76) Inventor: Jary Edward Tindall, Hattiesburg, MS (US)

( * ) Notice: Subject to any disclaimer, the term of this patent is extended or adjusted under 35 U.S.C. 154(b) by 0 days.

(21) Appl. No.: 13/500,182

(22) PCT Filed: Oct. 6, 2010

(86) PCT No.: PCT/US2010/051587

§ 371 (c)(1),
(2), (4) Date: Apr. 4, 2012

(87) PCT Pub. No.: WO2011/044204

PCT Pub. Date: Apr. 14, 2011

(65) Prior Publication Data

US 2012/0198612 A1 Aug. 9, 2012

Related U.S. Application Data

(60) Provisional application No. 61/249,081, filed on Oct. 6, 2009.

(51) Int. Cl.
*A61G 7/10* (2006.01)

(52) U.S. Cl.
USPC ..... 5/83.1; 5/89.1; 5/81.1

(58) Field of Classification Search
USPC ..... 5/89.1, 81.1, 83.1, 84.1, 612; 294/67.1
See application file for complete search history.

(56) References Cited

U.S. PATENT DOCUMENTS

| | | | | |
|---|---|---|---|---|
| 3,701,170 | A | 10/1972 | Bond | |
| 3,829,914 | A | 8/1974 | Treat | |
| 4,054,267 | A | 10/1977 | Berg et al. | |
| 4,627,119 | A | 12/1986 | Hachey et al. | |
| 5,406,658 | A * | 4/1995 | Olkkonen et al. | 5/83.1 |
| 5,499,408 | A | 3/1996 | Nix | |
| 5,539,941 | A * | 7/1996 | Fuller | 5/85.1 |
| 6,006,377 | A * | 12/1999 | Asakawa | 5/83.1 |
| 6,600,278 | B1 | 7/2003 | Bretzius | |
| 7,278,808 | B1 | 10/2007 | Sisk, Sr. et al. | |
| 2005/0044629 | A1 | 3/2005 | Rouse et al. | |

FOREIGN PATENT DOCUMENTS

GB 191300459 A 0/1913

* cited by examiner

*Primary Examiner* — Fredrick Conley
(74) *Attorney, Agent, or Firm* — King & Schickli, PLLC

(57) ABSTRACT

A personal lifting device includes a housing that carries first, second, third and fourth lifting mechanisms. First, second, third and fourth lift lines are connected to the respective lifting mechanisms. Further, the device includes a controller for selectively operating the first, second, third and fourth lifting mechanisms whereby the first, second, third and fourth lifting lines are independently extended and retracted as desired to lower and lift a person.

15 Claims, 9 Drawing Sheets

20
12
18
16
14
30
52
54
56
58
50
94
96
98
100
101
102
103
24
26

PERSONAL LIFTING DEVICE

This application is a national stage of International Application no. PCT/US10/51587 filed on 6 Oct. 2010 which claims the benefit of U.S. provisional patent application Ser. No. 61/249,081 filed on 6 Oct. 2009.

TECHNICAL FIELD AND INDUSTRIAL APPLICABILITY OF THE INVENTION

The present invention relates generally to the field of mobility devices and, more particularly, to a personal lifting device that may be used to raise or lower a physically disabled individual or patient.

BACKGROUND OF THE INVENTION

Personal lifting devices for the purpose of assisting in the raising or lowering of immobilized or physically disabled patients are well known in the art. U.S. Pat. Nos. 4,627,119 and 6,006,377 both disclose lifting devices that are useful to raise and lower patients between prone, inclined and sitting positions. The apparatus disclosed in these documents include four-point lifting systems incorporating four separate lift lines. It should be appreciated, however, that only two motors are provided for extending and retracting the four lift lines and thereby raising and lowering patients.

While such devices provide good stability and are useful for their intended purpose, driving more than one lift line with a single motor limits the versatility and usefulness of the devices. For example, in the absence of independent control of each lift-line it is not possible to move the individual shoulder or leg of a patient or to adjust for lift-line or strap tension if one side becomes elongated or stretched more than the other.

Typically a patient is supported in a lift pad or harness during lifting. In the absence of individual, independent lift-line control it is not possible to adjust either side of the lift pad for any imbalance that might occur due to a patient being positioned off center on the pad. Further, the devices cannot be used to effectively roll the patient onto their side in either direction. Still further, if either one of the lift motors fails, that end of the lift pad cannot be moved in either direction. In addition, the two devices disclosed in these patents require the use of "in-line" motors. Such motors mandate the use of electronic braking devices which not only increase the capital cost of the equipment but add a layer of technology that requires maintenance and could potentially fail which could result in a patient fall.

U.S. Pat. Nos. 7,634,825 and 7,240,621 both disclose lift devices including a single lift line or strap controlled by a single motor. The patient being moved or lifted is held in a harness. While useful, it should be appreciated that the individual or patient being lifted must first be positioned in the harness. Thus, the caregiver must physically manipulate the individual or patient in order to position him in the harness. Further, the physical manipulation of the patient is often difficult and painful for the patient. The physical exertion required by the caregiver may tax the individual or cause injury if it isn't beyond the caregiver's capability.

The present invention relates to a new and improved personal lifting device incorporating four lift lines which are all individually and independently controlled. This enhances the versatility of the device allowing it to be used to move an individual shoulder or leg, adjust for imbalances, adjust for differing strap tension and even used to roll a patient onto either side as desired. Further, this may all be accomplished without any physical exertion by the caregiver. In fact, for some applications the disabled patient may be able to use the device to move themselves. Thus, the personal lifting device of the present invention is more versatile and useful than those of the prior art thereby representing an advance in the art.

SUMMARY OF THE INVENTION

In accordance with the purposes of the present invention as described herein, a personal lifting device is provided. The personal lifting device includes a housing. First, second, third and fourth lifting mechanisms are carried on the housing. First, second, third and fourth lift lines are connected to the respective first, second, third and fourth lifting mechanisms. Further, a controller is provided for selectively operating the first, second, third and fourth lifting mechanisms whereby the first, second, third and fourth lift lines are independently extended and retracted as desired to lower and lift a patient.

The lifting device further includes a guide track and a suspension mechanism by which the housing is suspended from the guide track. The suspension mechanism includes a trolley having at least two guide rollers engaged with the guide track and a drive motor for driving at least one of the at least two guide rollers and selectively displacing the housing along the guide track. The controller also operates this drive motor. The controller includes a remote control keypad having a transmitter for transmitting control signals and a cooperating receiver in the housing for receiving the control signals.

In accordance with additional aspects of the present invention, the lifting device includes a lifting pad, a first lifting bar and a second lifting bar. The lifting pad includes a main body having a patient support face, a first side and a second side. A first series of lifting loops are provided along the first side of the lifting pad. A second series of lifting loops are provided on the second side of the lifting pad.

The first and second lift lines are connected to the first lifting bar and the third and fourth lift lines are connected to the second lifting bar. In addition, the device includes first, second, third and fourth secondary lines. The first secondary line connects the first lifting bar to a first loop of the first series of loops, the second secondary line connects the first lifting bar to a second loop of the second series of loops, the third secondary line connects the second lifting bar to a third loop of the first series of loops and the fourth secondary line connects the second lifting bar to a fourth loop of the second series of loops.

Still further describing the invention, the housing of the lifting device includes first, second, third and fourth corners. The first, second, third and fourth lifting mechanisms are mounted adjacent to the respective first, second, third and fourth corners. Each of the first, second, third and fourth lifting mechanisms includes and inverter duty gear motor, a variable frequency drive to control power distribution to the inverter duty gear motor, a gear head bracket assembly and a drive shaft. Each drive shaft includes a slot. One of the first, second, third and fourth lift lines is received and held in one of the drive shafts so that it may be wound onto and off of the drive shaft to raise and lower a patient.

Further, each of the first, second, third and fourth lift lines extends through an opening in the housing. A lift line roller assembly is mounted in the housing adjacent each opening. Each lift line roller assembly engages one of the first, second, third and fourth lift lines so that the lift lines may pass freely through the openings without binding against the housing even when positioned at an unusual angle during operation of the device.

In accordance with an additional aspect of the present invention a method is provided for lifting a person using a personal lifting device and a lifting pad. The method comprises connecting first, second, third and fourth lift lines to the lifting pad upon which a patient is supported and independently controlling the first, second, third and fourth lift lines so that the lift lines are selectively extended or retracted to move that patient on the lifting pad from a first position to a second position. The method further includes displacing the personal lifting device while the patent is held on the lifting pad.

In accordance with still another aspect of the present invention, a lifting pad is provided. The lifting pad comprises a main body having a patient support face, a first side and a second side. A first series of lifting loops are provided along the first side of the main body. A second series of lifting loops are provided along a second side of the main body. The first series of lifting loops are provided in a first set adjacent the first end of the main body and a second set adjacent a second end of the main body while the second series of lifting loops are provided in a third set adjacent the first end of the main body and a fourth set adjacent the second end of the main body.

In the following description there is shown and described several different embodiments of the invention, simply by way of illustration of some of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated herein and forming a part of the specification, illustrate several aspects of the present invention and together with the description serve to explain certain principles of the invention. In the drawings.

Figure 1:
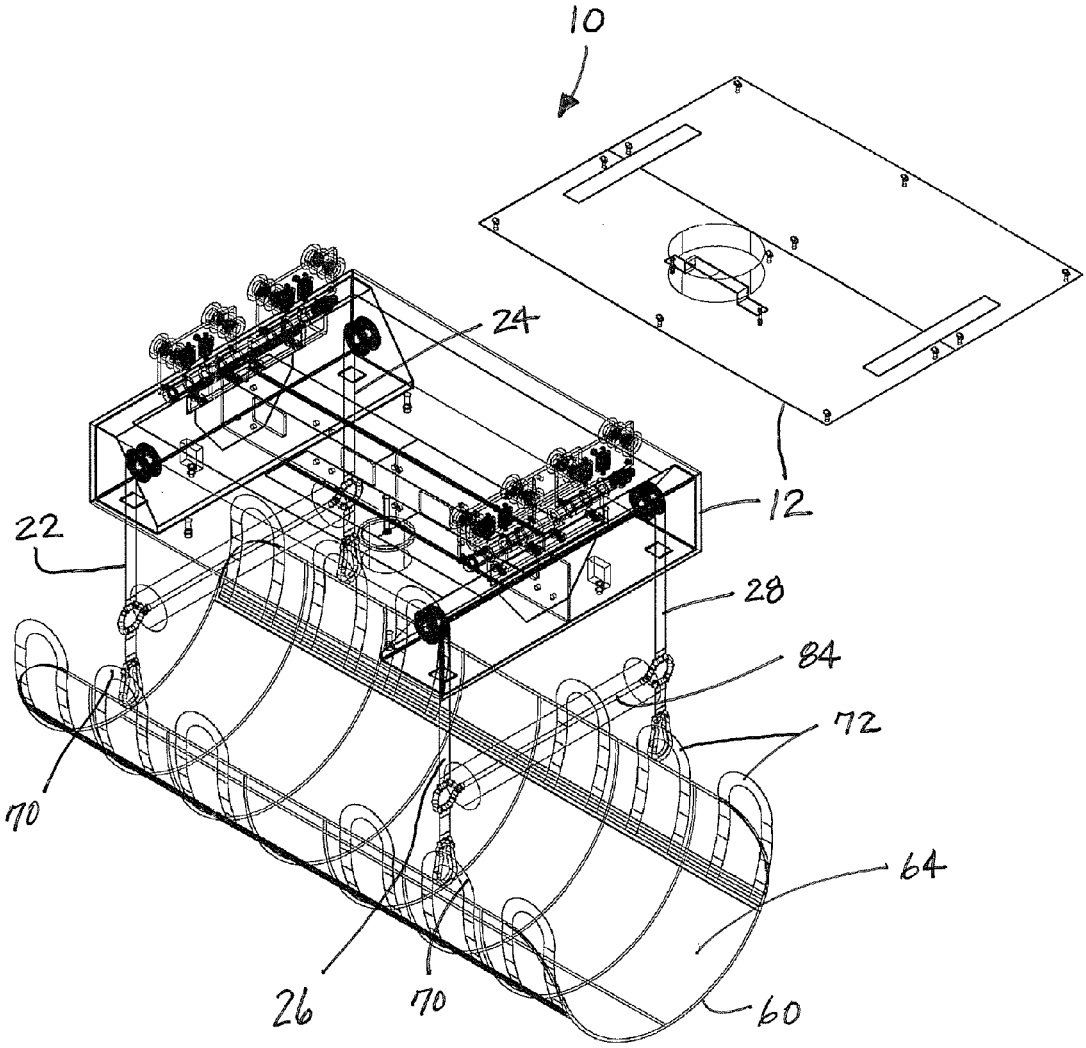
FIG. 1 is perspective view of the lifting device of the present invention.
Figure 2:
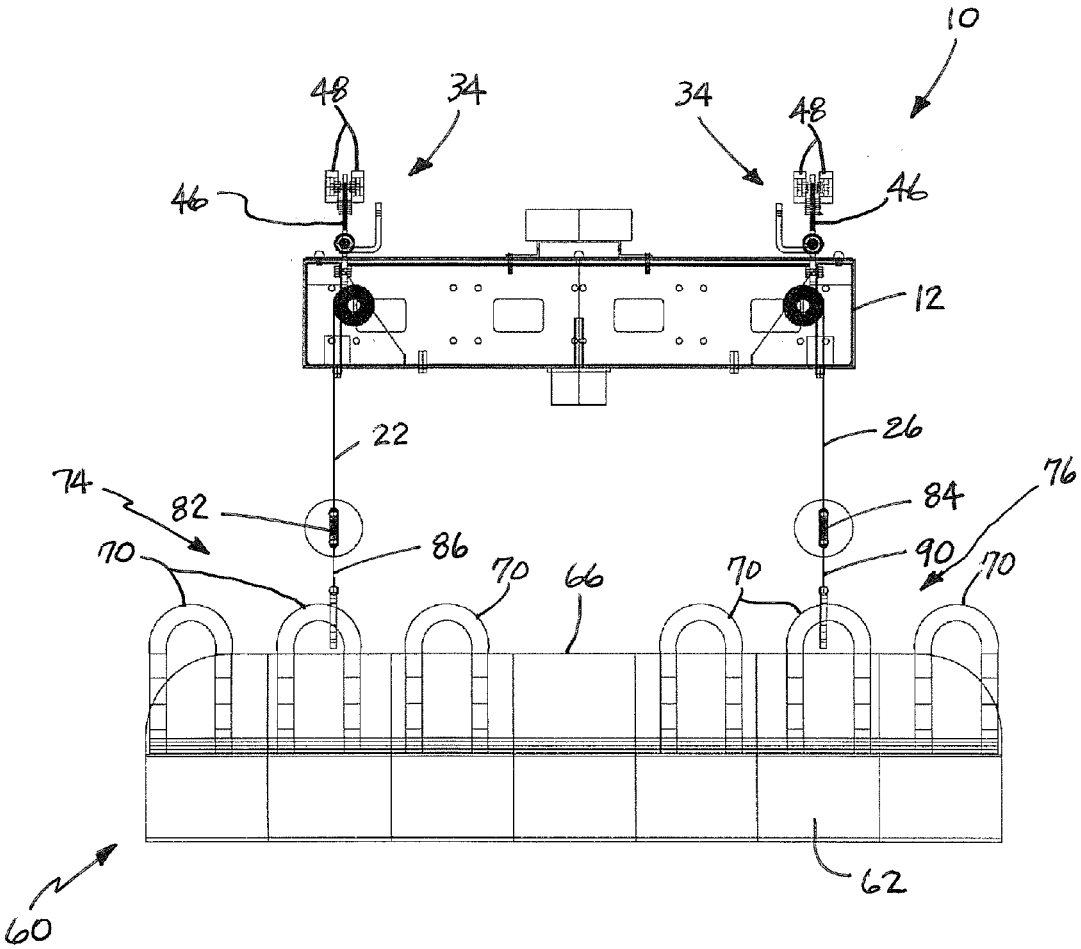
FIG. 2 is a side elevational view of the device illustrated in FIG. 1.
Figure 3:
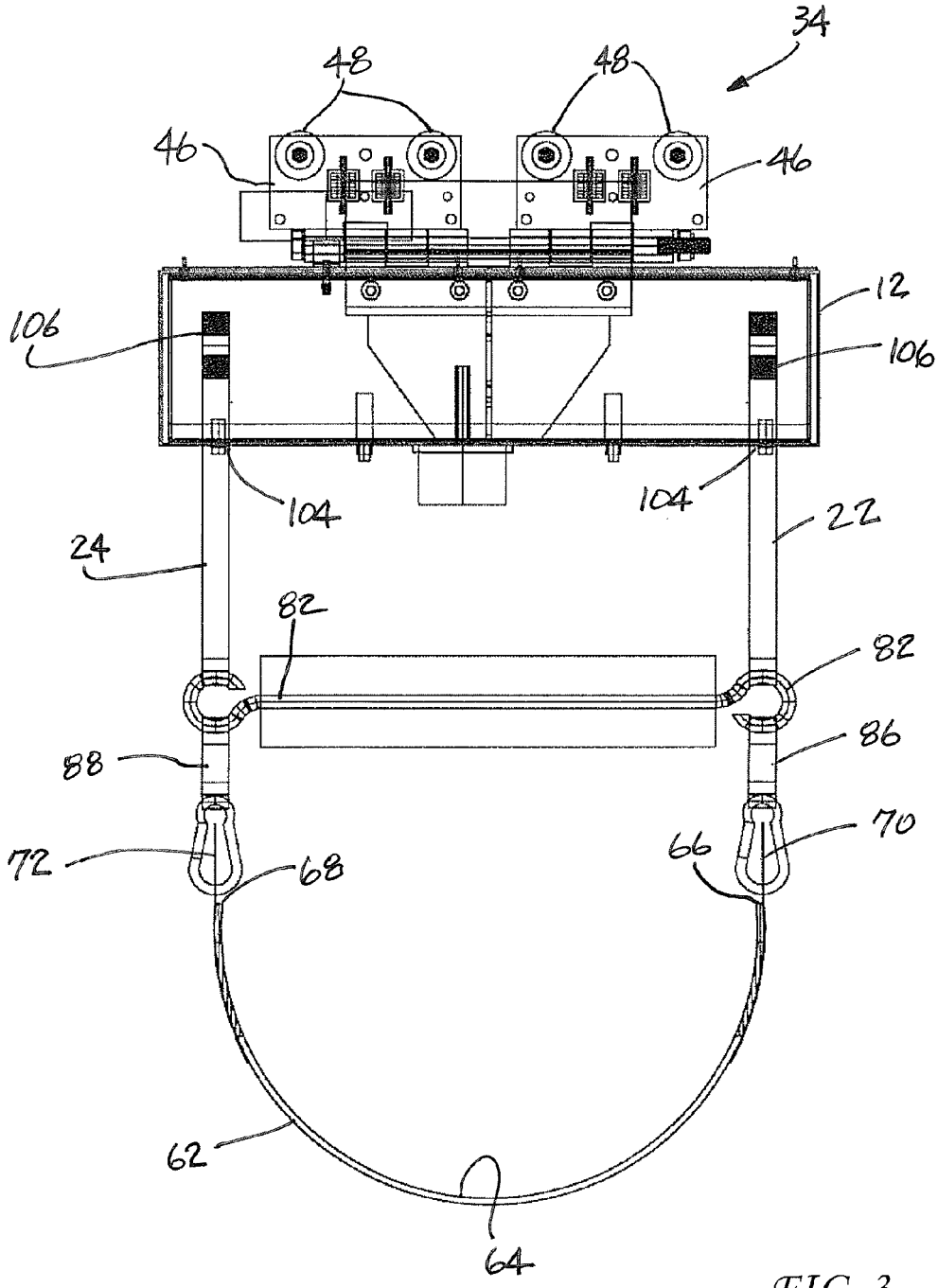
FIG. 3 is an end elevational view of the device illustrated in FIG. 1.

Reference will now be made in detail to the present preferred embodiment of the invention, examples of which are illustrated in the accompanying drawings.

DETAILED DESCRIPTION OF THE PREFERRED EMBODIMENTS OF THE INVENTION

Reference is now made to FIGS. 1-5 illustrating the personal lifting device 10 of the present invention. The lifting device 10 includes a housing 12 containing a first lifting mechanism 14, a second lifting mechanism 16, a third lifting mechanism 18 and a fourth lifting mechanism 20. More specifically, the first lifting mechanism 14 is carried on the housing 12 adjacent the first corner of the housing, the second lifting mechanism 16 is carried on the housing 12 adjacent the second corner of the housing, the third lifting mechanism 18 is carried on the housing 12 adjacent the third corner of the housing and the fourth lifting mechanism 20 is carried on the housing 12 adjacent the fourth corner of the housing. A first lift line 22 is connected to the first lifting mechanism 14. A second lift line 24 is connected to the second lifting mechanism 16. A third lift line 26 is connected to the third lifting mechanism 18. A fourth lift line 28 is connected to the fourth lifting mechanism 20. For purposes of this description the term "line" means any length of material suitable for supporting/suspending a lift pad and an individual or patient on the pad including, but not limited to, a strap, cord, chain or other like devices.

The device 10 also includes a controller 30 for selectively operating the first, second, third and fourth lifting mechanisms 14, 16, 18, 20 whereby the first, second, third and fourth lift lines 22, 24, 26, 28 are independently extended and retracted as desired to lower and raise and individual or patient in a manner described in greater detail below. The device 10 may be powered by connection to a standard electrical wall outlet. Further, the device 10 may include a battery backup system in case of a power failure.

Figure 4:
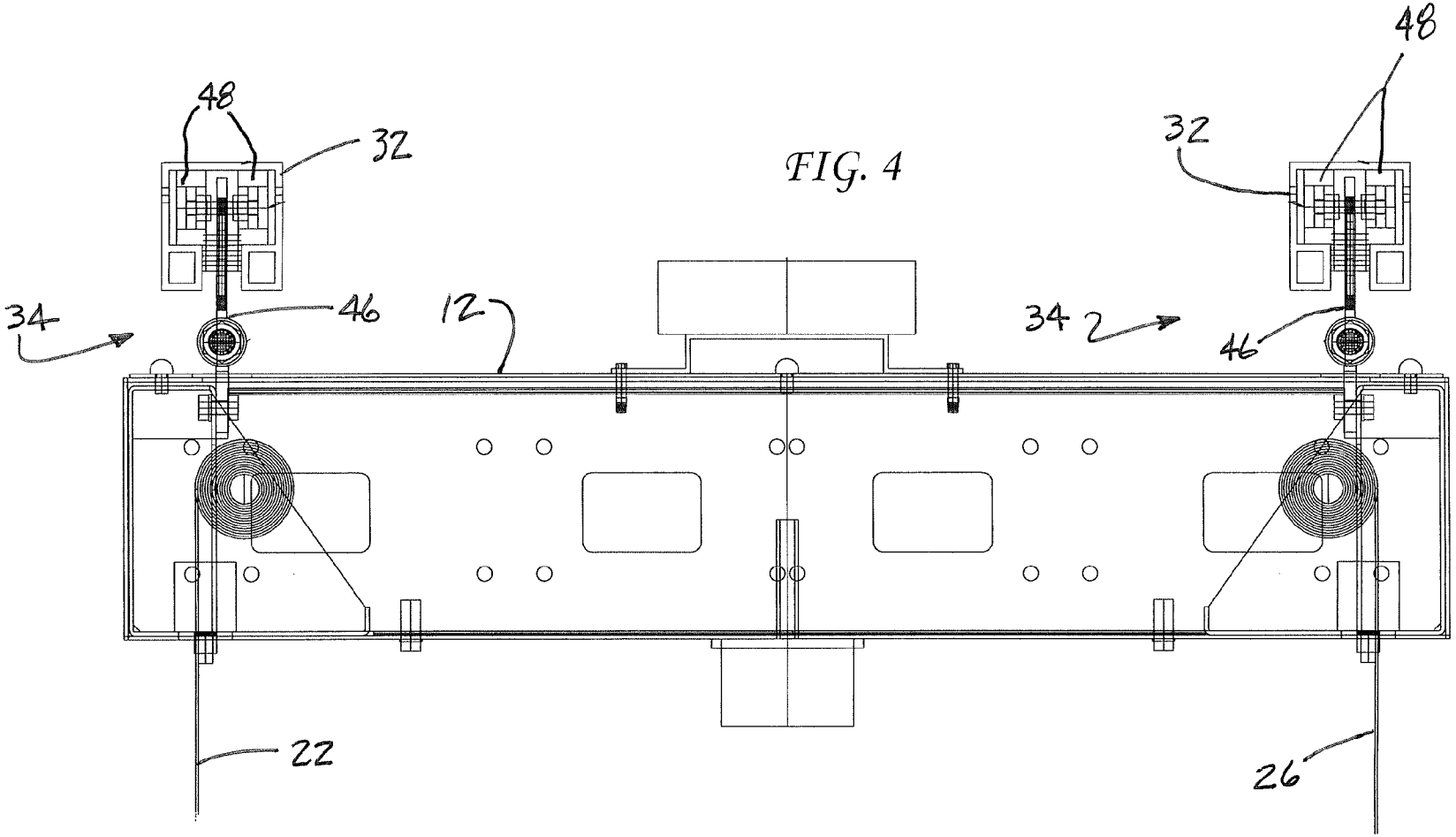
FIG. 4 is a schematical illustration of the personal lifting device of the present invention illustrating connection of the housing to an overlying guide track by means of a suspension mechanism.
Figure 7A:
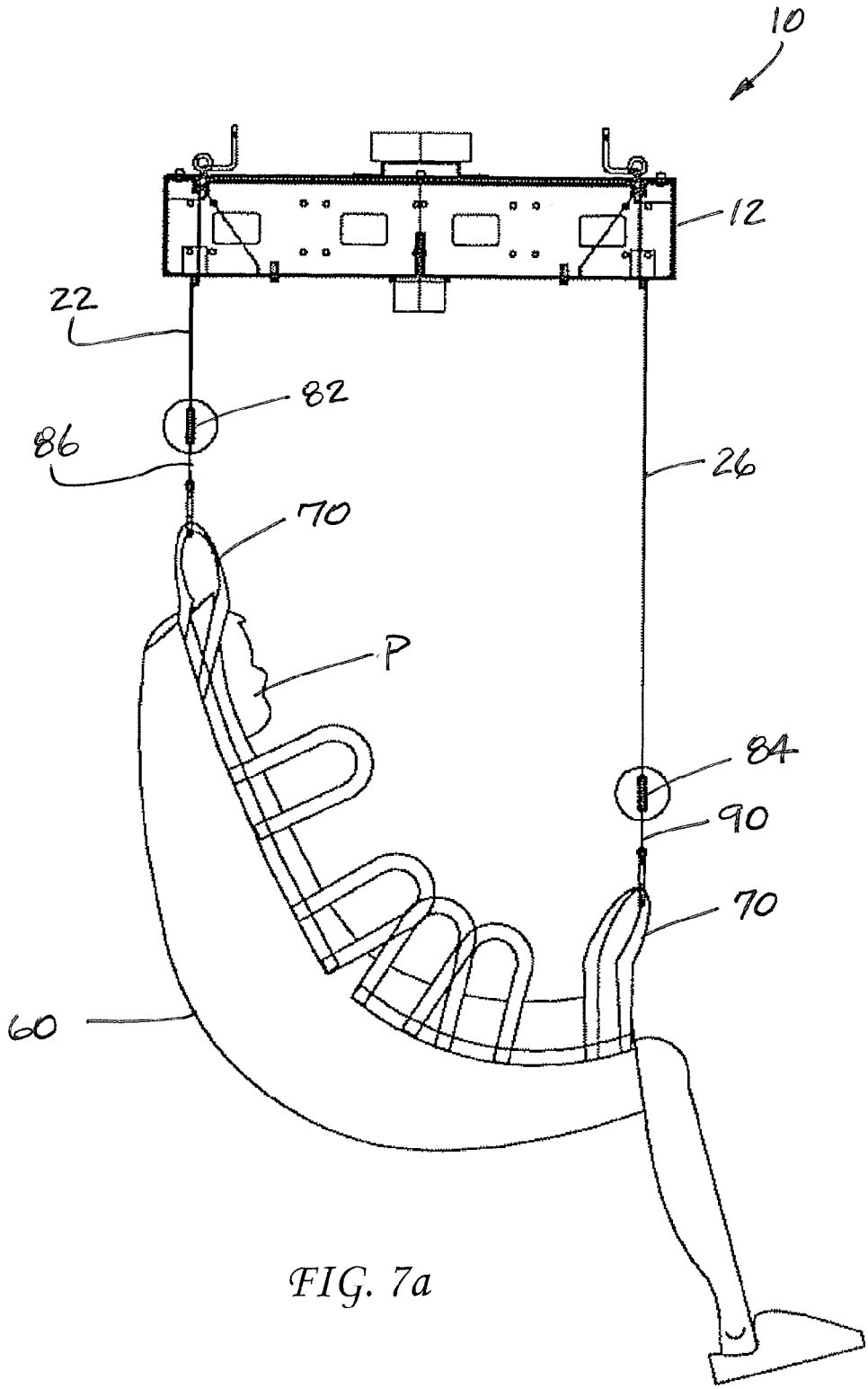
FIGS. 7*a*-7*c* are side elevational views illustrating the lifting device of the present invention utilized to hold the patient in, respectively, sitting, prone and basket positions.
Figure 7B:
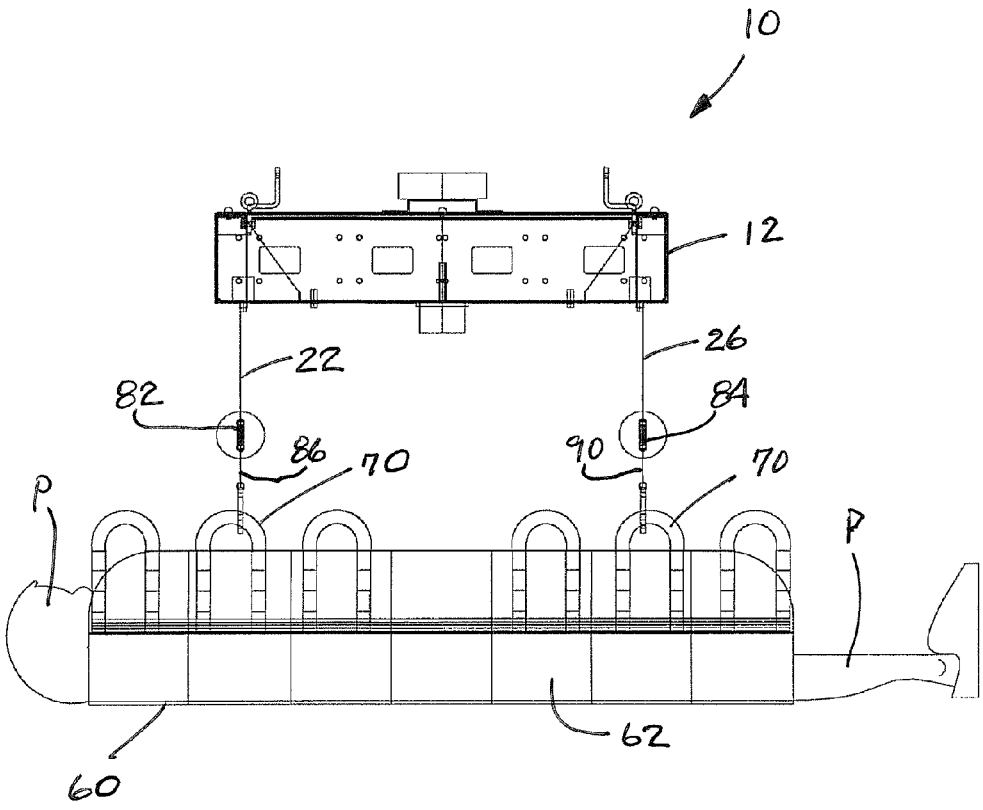
Figure 7C:
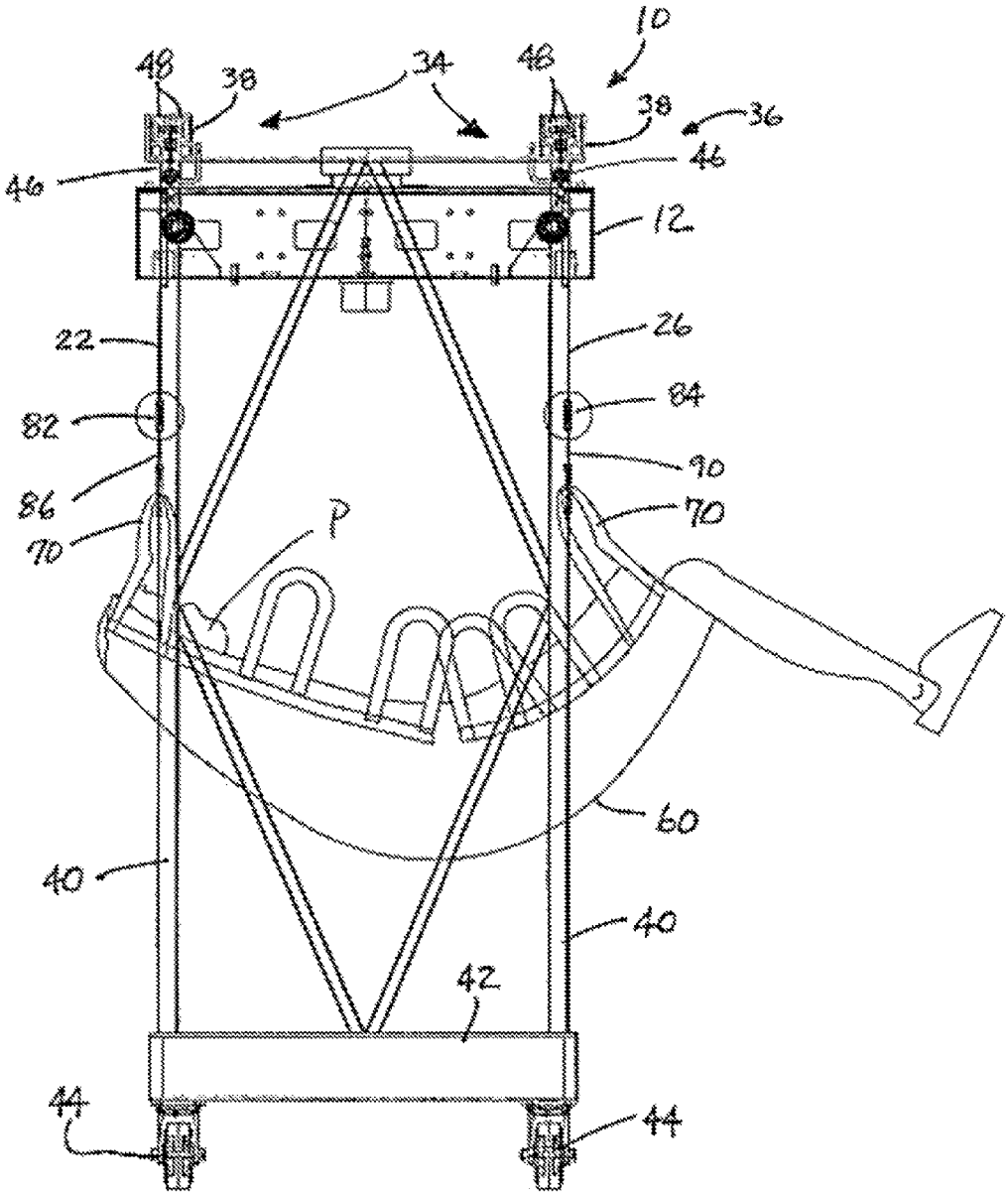

As best illustrated in FIG. 4, the personal lifting device 10 may further include an elongated guide track 32 and a suspension mechanism, generally designated by reference numeral 34, by which the housing 12 is suspended from the guide track. The guide track 32 may comprise a stationary rail that is secured into the structural framework of a building in which the lifting device 10 is to be operated. Alternatively, the guide track may be part of a moveable gantry system 36 (see FIG. 7*c*). As illustrated in FIG. 7*c*, the gantry system 36 may comprise two parallel guide track rails 38 supported on upstanding posts 40 secured to a base 42 supported on casters 44 that allow the gantry system 36 to be selectively moved across the floor.

In either embodiment, the suspension mechanism 34 includes a trolley 46 that is fixed to the housing 12. The trolley 46 carries at least two guide rollers 48 that engage with the guide track 32. A drive motor 50 is provided to drive at least one of the guide rollers 48 to allow an operator to selectively displace the housing 12 along the guide track 32.

As best illustrated in FIGS. 1, 2, 6 and 7*a*-7*c*, the lifting device 10 also includes a lifting pad 60. The lifting pad 60 includes a main body 62 having a patient support face 64, a first side 66 and a second side 68. A first series of lifting loops 70 are provided along the first side 66 of the lifting pad 60 and a second series of lifting loops 72 are provided along the second side 68 of the lifting pad 60. In the illustrated embodiment the first series of lifting loops 70 includes a first set 74 of lifting loops provided adjacent a first end of the main body 62 and a second set 76 of lifting loops adjacent a second end of the main body. Similarly, the second series of lifting loops 72 includes a third set 78 of lifting loops provided adjacent the first end of the main body 62 and a fourth set 80 of lifting loops provided adjacent a second end of the main body.

The lifting pad 60 may comprise a medical industry accepted bed pad modified with high tensile strength strap handles forming the lifting loops 70, 72. Such a pad includes no metal or other materials that might interfere with diagnostic testing equipment such as NMR and CT scanning equipment commonly used in hospitals. Accordingly, there is no need to remove the person or patient P from the pad 60 under any circumstance thereby meaning that the caregiver can complete all movements of the person using the personal lifting device 10 without actual physical exertion.

As further illustrated, the lifting device 10 includes a first lifting bar 82 and a second lifting bar 84. The first and second lift lines 22, 24 are connected to the first lifting bar 82 while the third and fourth lift lines 26, 28 are connected to the second lifting bar 84.

As further illustrated in the drawing figures, the lifting device 10 includes a first secondary lift line 86, a second secondary lift line 88, a third secondary lift line 90 and a fourth secondary lift line 92. The first secondary lift line 86 connects the first lifting bar 82 to a first loop of the first series of loops 70. The second secondary lift line 88 connects the first lifting bar 82 to a second loop of the second series of loops 72. The third secondary lift line 90 connects the second lifting bar 84 to a third loop of the first series of loops 70 while the fourth secondary lift line 92 connects the second lifting bar 84 to a fourth loop of the second series of loops 72. The connection between each secondary lift line 86, 88, 90, 92 and each loop 70, 72 may be made using a carabiner or other appropriate connector/fastener.

Figure 5:
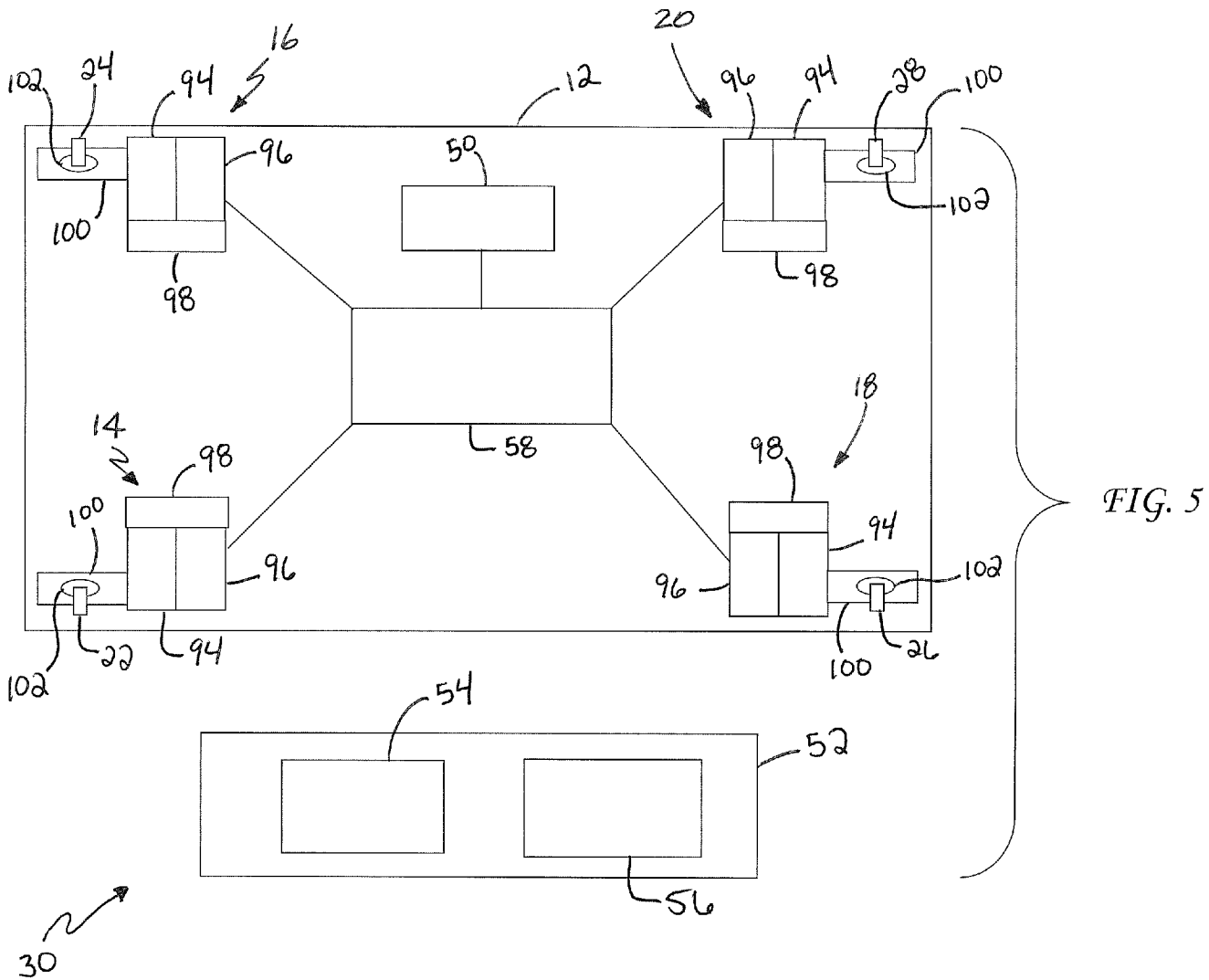
FIG. 5 is a schematical illustration of the control system and the four lifting mechanisms of the device of the present invention.
Figure 6:
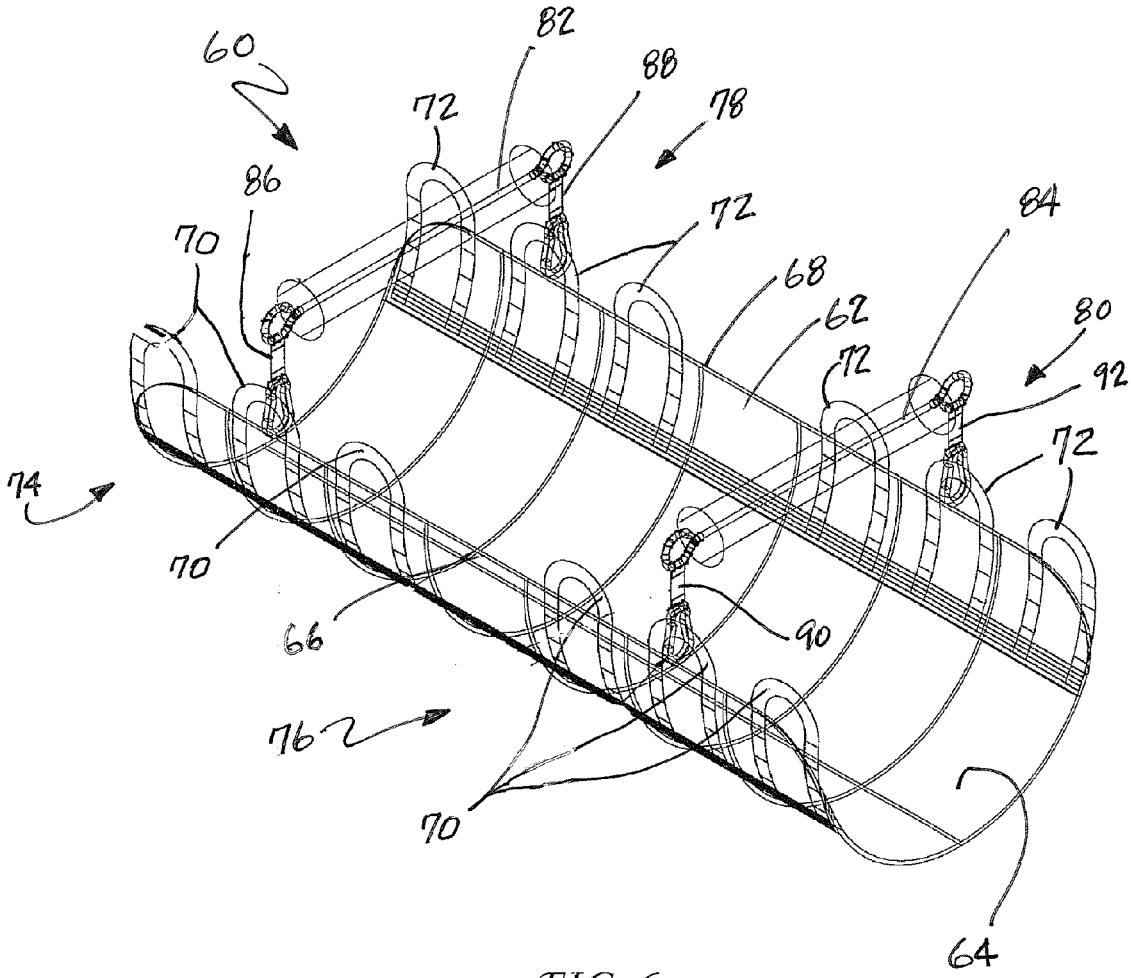
FIG. 6 is a perspective view of the lifting pad of the present invention.

As best illustrated in FIG. 5 each of the first, second, third and fourth lifting mechanisms 14, 16, 18, 20 includes an inverter duty gear motor 94, a variable frequency drive 96 to control power distribution to the inverter duty gear motor 94, a gear head bracket assembly 98 and a drive shaft 100. Each drive shaft includes a slot 102. One lift line 22, 24, 26, 28 is received and held in the slot 102 so that that lift line is wound onto and off of the drive shaft 100 when the inverter duty gear motor 94 is activated by the controller 30 to extend or retract the associated lift line.

Each lift line 22, 24, 26, 28 extends through an opening 104 provided adjacent a corner of the housing 12. A lift line roller assembly 106 mounted in the housing 12 adjacent the opening 104 engages that lift line 22, 24, 26, 28 so that the lift line may pass freely through the opening without binding against the housing when angled into any possible anticipated operating position.

Reference is now made to FIG. 5 illustrating the control system of the present invention. As illustrated, the controller 30 is operatively connected to the first, second, third and fourth lifting mechanisms 14, 16, 18, 20 which allow the respective first, second, third and fourth lift lines 22, 24, 26, 28 to be extended and retracted as desired and the drive motor 50 which drives at least one of the guide rollers 48 to allow the housing 12 to be translated back and forth along the guide track 32. More specifically, the controller 30 includes a remote control 52 incorporating an operator interface in the form of a keypad 54 and a transmitter 56 for transmitting control signals to a receiver 58 in the housing 12. The receiver 58 is connected to four independent variable frequency drives 96. One such variable frequency drive 96 is connected to each inverter duty gear motor 94 at each corner of the housing 12. This arrangement allows the controller 30 to individually and independently control the retraction and extension of each lift line 22, 24, 26, 28.

The present invention further includes a method of lifting a person using the personal lifting device 10 including the lifting pad 60. The method comprises connecting the first, second, third and fourth lift lines 22, 24, 26, 28 to the lifting pad 60 upon which the person P is supported (see, for example, FIGS. 7*a*-7*c*). This connection is made through the lifting bars 82, 84 and the first, second, third and fourth secondary lift lines 86, 88, 90, 92. When it is desired to hold the person P in a sitting position, the connection may be made as illustrated in FIG. 7*a*. When it is desired to hold the person P in a prone position, the connection may be made as illustrated in FIG. 7*b*. When it is desired to hold the person P in a basket position, the connection may be made as illustrated in FIG. 7*c*.

The method further includes independently controlling the first, second, third and fourth lift lines 22, 24, 26, 28 so that the lift lines are selectively extended or retracted to move the patient or person P on the lifting pad 60 from a first position to a second position. As noted above, each lifting mechanism 14, 16, 18, 20 includes its own independent inverter duty gear motor 94 and variable frequency drive 96. Thus, each motor 94 may be used to raise or lower the individual lift lines 22, 24, 26, 28 independently of the other motors. Thus, the head end lift lines 22, 24 may be retracted or extended simultaneously. Similarly, the leg end lift lines 26, 28 may be retracted or extended simultaneously. Likewise, it should also be appreciated that the first and third lift lines 22, 26 may be retracted or extended simultaneously. Similarly, the second and fourth lift lines 24, 28 may be retracted or extended simultaneously. In fact, any individual lift line 22, 24, 26, 28, any two lift lines, any three lift lines or all four lift lines may be retracted or extended independent of the others as desired simultaneously or otherwise.

Accordingly, the personal lifting device of the present invention provides unparalleled versatility allowing a person to be raised and lowered into multiple positions depending on motor/lift line operation. Thus, for example, a person can be raised or lowered from a prone position to a sitting position or from a sitting position to a prone position. Further, a person may be raised or lowered while in the prone position or in the sitting position. Once the person is raised on the pad 60, the drive motor 50 may be activated to move the housing 12 and the person P on the pad 60 along the guide track 32 in a horizontal plane for the distance of the guide track. The convenient remote control 52 may even be used by a person P on the pad 60 to move themselves. Alternatively, a separate caretaker may use the remote control 52 to perform the lifting and moving operation. Significantly, it should be appreciated that the fully independent control of the first, second, third and fourth lift lines 22, 24, 26, 28 allows unparalleled performance features including, for example, the ability of the operator to roll the person P on the pad 60 from, for example, their left side to their back, their back to their right side, their back to their left side or from their right side to their back as desired. Advantageously, all movements of the person P on the pad 60 may be completed using the lifting device 10 making it unnecessary for the caregiver to physically perform any of the movements. Thus, the caregiver is no longer required to physically exert himself and risk potential injury. Further, caregivers having a physical stature unable to otherwise move a person P on the pad 60 are now fully enabled to perform that task.

The foregoing description of the preferred embodiments of the present invention have been presented for purposes of illustration and description. It is not intended to be exhaustive or to limit the invention to the precise form disclosed. Obvious modifications or variations are possible in light of the above teachings. The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims in their fair and broad interpretation in any way.

What is claimed is:

1. A personal lifting device, comprising:

a housing;

a first lifting mechanism carried on said housing;

a second lifting mechanism carried on said housing;

a third lifting mechanism carried on said housing;

a fourth lifting mechanism carried on said housing;

a first lift line connected to said first lifting mechanism;

a second lift line connected to said second lifting mechanism;

a third lift line connected to said third lifting mechanism;

a fourth lift line connected to said fourth lifting mechanism;

a controller for selectively operating said first, second, third and fourth lifting mechanisms whereby said first, second, third and fourth lift lines are independently extended and retracted as desired to lower and lift a person;

a lifting pad having a length greater than a width;

a first lifting bar hanging from said first and second lift lines and extending transversely across said width of said lifting pad;

a second, separate lifting bar hanging from said third and fourth lift lines and extending transversely across said width of said lifting pad.

2. The lifting device of claim 1, further including a guide track and a suspension mechanism by which said housing is suspended from said guide track.

3. The lifting device of claim 2, wherein said suspension mechanism includes a trolley having at least two guide rollers engaged with said guide track and a drive motor for driving at least one of said at least two guide rollers and selectively displacing said housing along said guide track.

4. The lifting device of claim 3, wherein said controller also operates said drive motor.

5. The lifting device of claim 4, wherein said controller includes a remote control keypad having a transmitter for transmitting control signals and a cooperating receiver in the housing for receiving said control signals.

6. The lifting device of claim 1, wherein said lifting pad includes a patient support surface, a first side and a second side, said first and second lifting bars extending transversely across said lifting pad between said first and second sides.

7. The lifting device of claim 6, further including a first series of lifting loops provided along said first side of said lifting pad and a second series of lifting loops provided along said second side of said lifting pad.

8. The lifting device of claim 7, further including a first secondary line, a second secondary line, a third secondary line and a fourth secondary line wherein said first secondary line connects said first lifting bar to a first loop of said first series of loops, said second secondary line connects said first lifting bar to a second loop of said second series of loops, said third secondary line connects said second lifting par to a third loop of said first series of loops and said fourth secondary line connects said second lifting bar to a fourth loop of said second series of loops.

9. The lifting device of claim 1, wherein said housing includes a first corner, a second corner, a third corner and a fourth corner and said first lifting mechanism is mounted adjacent said first corner, said second lifting mechanism is mounted adjacent said second corner, said third lifting mechanism is mounted adjacent sad third corner and said fourth lifting mechanism is mounted adjacent said fourth corner.

10. A lifting pad, comprising:

a main body having a patient support face, a first side and a second side, said first and second sides extending along the length of said lifting pad;

a first series of lifting loops provided along said first side of said main body; and a second series of lifting loops provided along said second side of said main body;

wherein said first series of loops are provided in a first set adjacent a first end of said main body and a second set adjacent a second end of said main body and said second series of lifting loops are provided in a third set adjacent said first end of said main body and a fourth set adjacent said second end of said main body.

11. A personal lifting device, comprising:

a housing;

a first lifting mechanism carried within said housing;

a second lifting mechanism carried within said housing;

a third lifting mechanism carried within said housing;

a fourth lifting mechanism carried within said housing;

a drive motor carried within said housing;

a receiver carried within said housing, said receiver connected to said first lifting mechanism, said second lifting mechanism, said third lifting mechanism, and said drive motor.

a first lift line connected to said first lifting mechanism;

a second lift line connected to said second lifting mechanism;

a third lift line connected to said third lifting mechanism;

a fourth list line connected to said fourth lifting mechanism; and a controller for selectively operating said first, second, third and fourth lifting mechanisms whereby said first, second, third and fourth lift lines are independently extended and retracted as desired to lower and lift a person;

wherein said first, second, third and fourth lifting mechanisms each include an inverter duty gear motor, a variable frequency drive to control power distribution to said inverter duty gear motor, a gear head bracket assembly and a drive shaft.

12. The lifting device of claim 11, wherein said drive shaft includes a slot.

13. The lifting device of claim 12, wherein one of said first, second, third and fourth lift lines is received and held in said slot and is wound on and off said drive shaft.

14. The lifting device of claim 13, wherein each of first, second, third and fourth lift lines extends through an opening in said housing.

15. The lifting device of claim 14, further including a lift line roller assembly mounted in said housing adjacent said opening, said lift line roller assembly engaging one of said first, second, third or fourth lift lines so said one of said lift lines may pass freely through said opening without binding against said housing when angled into an operating position.

* * * * *